United States Patent [19]

Fortune

[11] Patent Number: 4,667,357

[45] Date of Patent: May 26, 1987

[54] SLEEP UNIT HAVING ADJUSTABLE FIRMNESS

[76] Inventor: Richard L. Fortune, 5440 Trentham Dr., Dunwoody, Ga. 30338

[21] Appl. No.: 917,074

[22] Filed: Oct. 8, 1986

[51] Int. Cl.[4] ..... A47C 23/04

[52] U.S. Cl. ..... 5/447; 5/475

[58] Field of Search ..... 5/447, 446, 448, 475

[56] References Cited

U.S. PATENT DOCUMENTS

| | | | |
|---|---|---|---|
| 2,257,994 | 10/1941 | Zofnass | 5/447 |
| 2,842,784 | 7/1958 | Grund | 5/447 |
| 2,985,895 | 5/1961 | Bloom | 5/447 |
| 3,551,924 | 5/1969 | Frye | 5/447 |
| 3,608,107 | 9/1971 | Kentor et al. . | |
| 4,222,137 | 9/1980 | Usami | 5/446 |

*Primary Examiner*—Alexander Grosz

*Attorney, Agent, or Firm*—Watson, Cole, Grindle & Watson

[57] ABSTRACT

A sleep unit having inner coil springs is adjustable for firmness by movement of an inner plate or frame having portions which extend between selected turns of the springs.

7 Claims, 8 Drawing Figures

SLEEP UNIT HAVING ADJUSTABLE FIRMNESS

BACKGROUND OF THE INVENTION

This invention relates generally to a sleep unit such as an inner spring mattress or a box spring mattress support, and more particularly to such unit having an internal plate or frame movable into a position in which portions thereof lie between selected turns of the springs for adjusting the firmness of the sleep unit.

Adjustable inner spring mattresses and box springs are known in which the compressability of the springs are adjusted to thereby adjust the firmness of the sleep unit. Otherwise, a central board may be employed for affecting the firmness of the sleep unit, or a plurality of adjustable tubes are used for adjusting the firmness.

SUMMARY OF THE INVENTION

A different approach is taken according to the invention for adjusting the firmness of the sleep unit in a more simple, less costly yet highly effective manner employing a minimum number of parts and effort.

The adjustable firmness sleep unit of the invention makes use of an internal, movable wall having a plurality of spaced portions extending parallel to the rows of inner springs of the unit, such portions each having a thickness less than the spacings between the spring turns, and the movable wall having openings located between the spaced portions. The springs extend through such openings in an out-of-service position of the movable wall. One of the side walls of the unit has an opening defining guide slots for the movable wall, and a handle on the movable wall extends through such opening. The guide slots extend in a direction parallel to the top and bottom walls of the unit, and a portion of the handle extends into a selected one of the guide slots upon manually shifting the movable wall from its out-of-service position to an in-service position in a direction perpendicular to the springs so as to insert its portions into selected ones of the turns of the coil spring for thereby adjusting the firmness of the sleep unit as the effective cushioning of the springs is changed.

The movable wall may comprise a flat plate containing rows of the openings corresponding to the rows of the springs, or a frame having interconnected slats defining the spaced portions.

The movable wall may be shifted in a direction parallel to the side walls of the unit, or in a direction parallel to the end walls thereof. And, the handle portion may be spring biased into the selected one of the guide slots.

Other objects, advantages, and novel features of the invention will become more apparent from the following detailed description of the invention when taken in conjunction with the accompanying drawings.

DETAILED DESCRIPTION OF THE INVENTION

Figure 1:
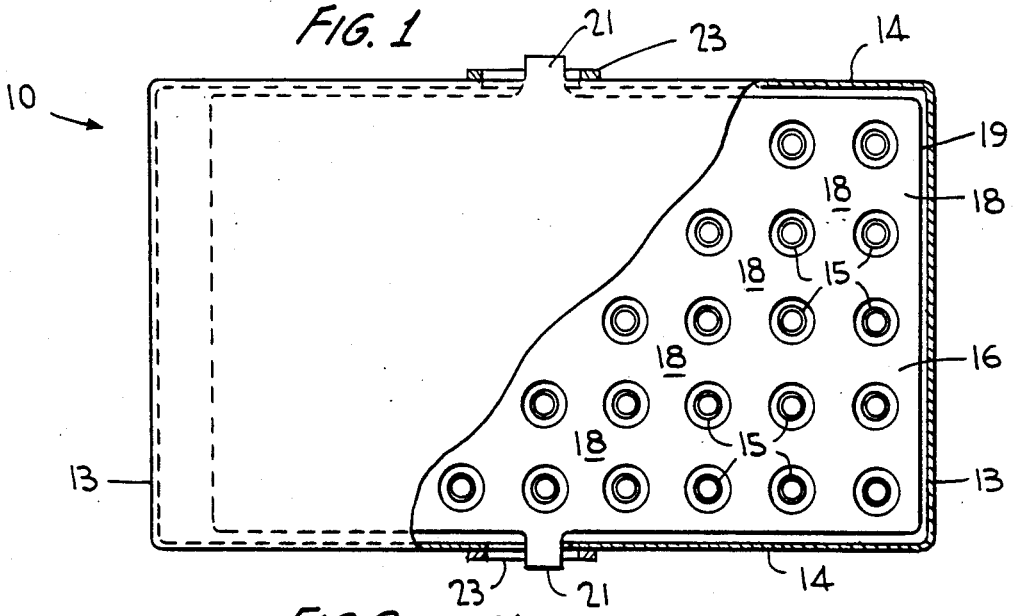
FIG. 1 is a top plan view, partly broken away, of a sleep unit according to the invention with the internal movable wall located in its out-of-service position.

Turning now to the drawings wherein like reference characters refer to like and corresponding parts throughout the several views, a sleep unit according to one embodiment of the invention is generally designated 10 in FIG. 1 and comprises a known inner spring mattress or a box spring unit customarily employed for supporting a mattress. The sleep unit is constructed in any normal manner and is illustrated only generally for the purpose of describing the invention. Thus, the unit has a top wall 11, a bottom wall 12, end walls 13, and side walls 14, all interconnected in any normal manner with the usual ribbing and tufting, the wall typically comprising a fabric covering or the like. A plurality of inner coil springs 15 are spaced apart and typically arranged in rows parallel to the end and side walls, extend between the top and bottom walls, and are stablized in the usual manner as by straps or clips (not shown). The specific construction of the inner spring mattress or box spring has nothing to do with the invention, it being understood that the sleep unit may be constructed in any normal manner.

In accordance with the invention, an internal, flat wall 16 is disposed within the unit substantially parallel to the top and bottom walls thereof. In the FIGS. 1 to 4 embodiment, this internal wall comprises a flat plate which may be of rigid material, such as plastic, wood or metal, having a plurality of openings 17 corresponding in number to each of the springs 15 and being of a size slightly greater than the springs, as shown in FIG. 1. A plurality of spaced portions 18 extend in a direction parallel to the end walls of the sleep unit starting at one end 19 of the flat plate and lying between the parallel rows of openings 17. In the out-of-service position of FIGS. 1 and 2, the springs extend through openings 17 and are free of engagement with portions 18 of the plate 16.

Figure 2:
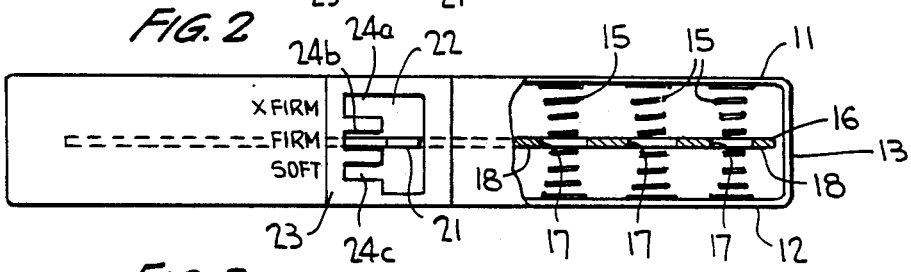
FIG. 2 is a side elevational view, partly broken away, of the sleep unit of FIG. 1.

The movable wall of the invention has handles 21 extending through openings 22 located in the side walls of the sleep unit. These openings may be located in support plates 23 mounted on the inside or outside of side walls 14. Openings 22 each have guide slots **24*a*, 24*b* and 24*c* extending in a direction parallel to the top and bottom walls of the sleep unit and indicia such as X FIRM, FIRM and SOFT may be applied to the outer surface of side walls 14 associated respectively with the slots, as shown in FIGS. 2 and 4**.

In operation, handles 21 are simply manually lifted for positioning the perforated plate to effect the desired degree of firmness. For example, the handles will be positioned juxtaposed to guide slots **24*b*, as shown in FIG. 2, selected for a firm setting. If an extra firm setting is desired, the handles are juxtaposed to guide slots 24*a*, and if a soft setting is desired, the handles are juxtaposed to guide slots 24*c***. The degree of firmness depends upon the cushioning effect provided by the coil springs. If, for example, only half the spring coils are available to the user of the sleep unit, the firmness of the sleep unit will be increased compared to that condition in which the full length of the springs are available for a cushioning effect.

Figure 3:
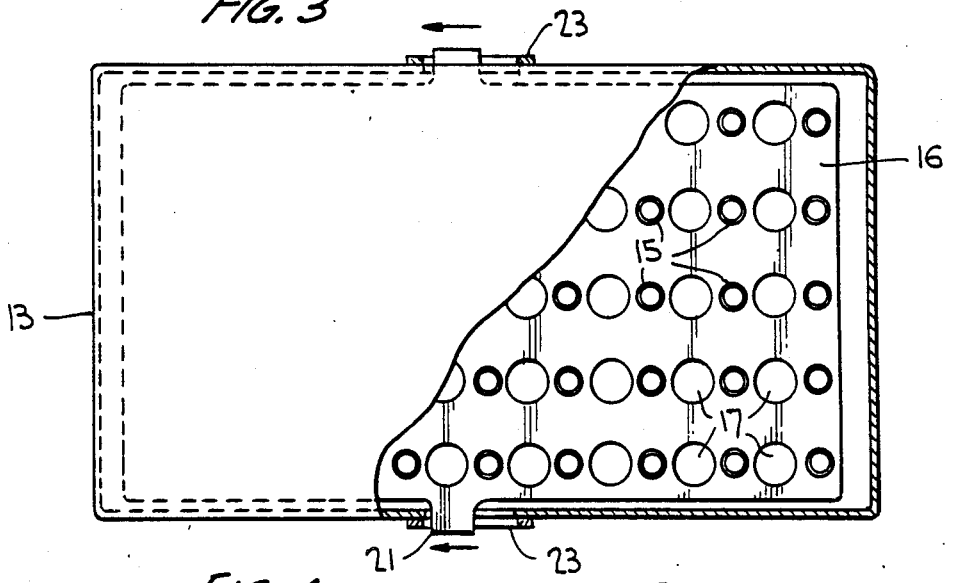
FIG. 3 is a view similar to FIG. 1 showing the movable wall shifted into its in-service position.
Figure 4:
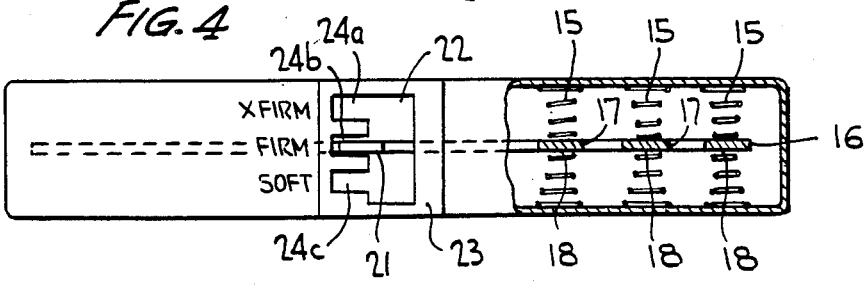
FIG. 4 is a side elevational view, partly broken away, of the FIG. 3 sleep unit.

As illustrated in FIGS. 3 and 4, perforated plate 16 is shown moved into its in-service position in which handles 21 engage guide slots 24*b*. And, portions 18 of plate 16 are shifted into place between the spaced turns of the adjacent springs in the arranged rows. If less firmness is required for the sleep unit, the handles are simply shifted back to the FIG. 2 position, lowered so as to be juxtaposed to guide slots 24*c*, and shifted back to an in-service position in which portions 18 now lie between the spaced turns of lower portions of springs 15 thereby increasing the length of the springs available to the user for lessening the firmness relative to the FIRM setting. And, if an extra firm setting is required, plate 16 is moved by its handles 21 to the out-of-service position in which portions 18 are disengaged from the spring turns, plate 16 is elevated until its handles are juxtaposed to guide slots 24*a*, and plate 16 is then shifted into its in-service position in a leftward direction when viewed in FIGS. 3 and 4. Again, portions 18 are inserted between spaced turns at elevated sections of the springs such that only a small degree of cushioning is made available to the user, and extra firmness is assured.

It should be pointed out that the drawings are not to scale, but merely illustrate the principal feature of the invention, i.e. adjusting the firmness of a sleep unit by selecting the spring length, and thus the cushioning, available to the user. Thus, all three firmness settings may be located between the middle section and bottom of the sleep unit, without departing from the invention. And, the spacings of the spring turns are slightly greater than the thickness of portions 18 so as to facilitate a rather smooth movement of portions 18 into and out of the spacings of the spring turns. Moreover, guide slots 24 may be only slightly wider than the thickness of the handles so as to facilitate an interference fit positively retaining plate 16 in its in-service position.

Although openings 22 and the associated guide slots are shown as located in side walls 14 and handles 21 extending from opposite sides of perforated plate 16, such openings and slots may be located in end walls 13, and the handle may extend from opposite ends of plate 16, without departing from the invention.

Figure 5:
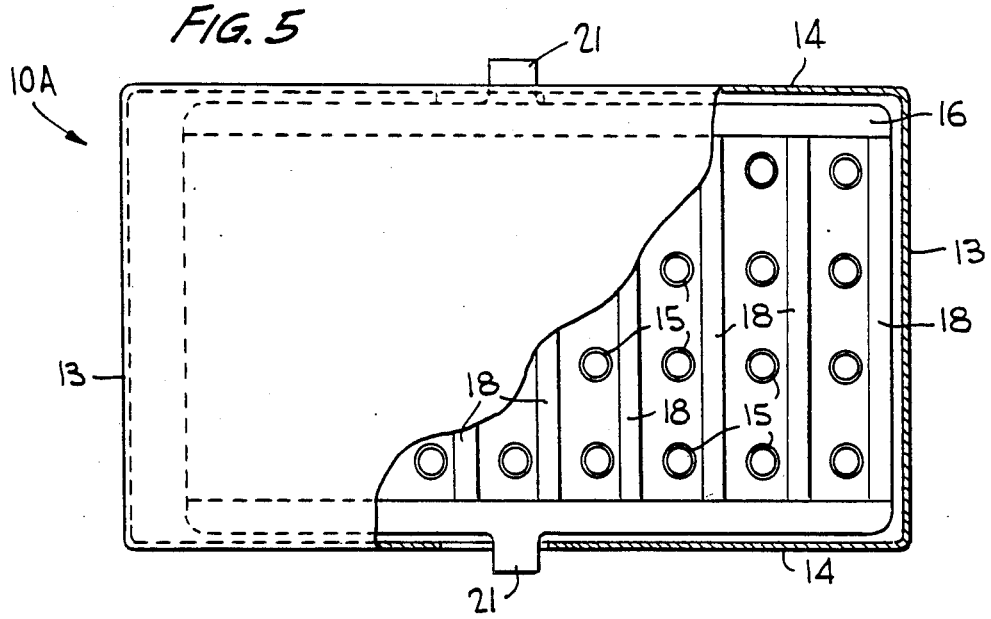
FIG. 5 is a top plan view, partly broken away, of a sleep unit according to another embodiment of the invention.

A sleep unit 10A according to another embodiment of the invention is illustrated in FIG. 5. Here, movable wall 16 comprises a frame having parallel slats defining portions 18. Otherwise, the movable wall is shifted between out-of-service and in-service positions parallel to side walls 14 for adjusting the firmness of the sleep unit in the same manner described with reference to FIGS. 1 to 4. The slats are shown parallel to end walls 13, although they could be arranged parallel to side walls 14 with the frame movable parallel to the end walls, without departing from the invention. Slatted openings 22 would thus be located in the end walls, and handles 21 would extend from opposite ends of the frame.

Figure 6:
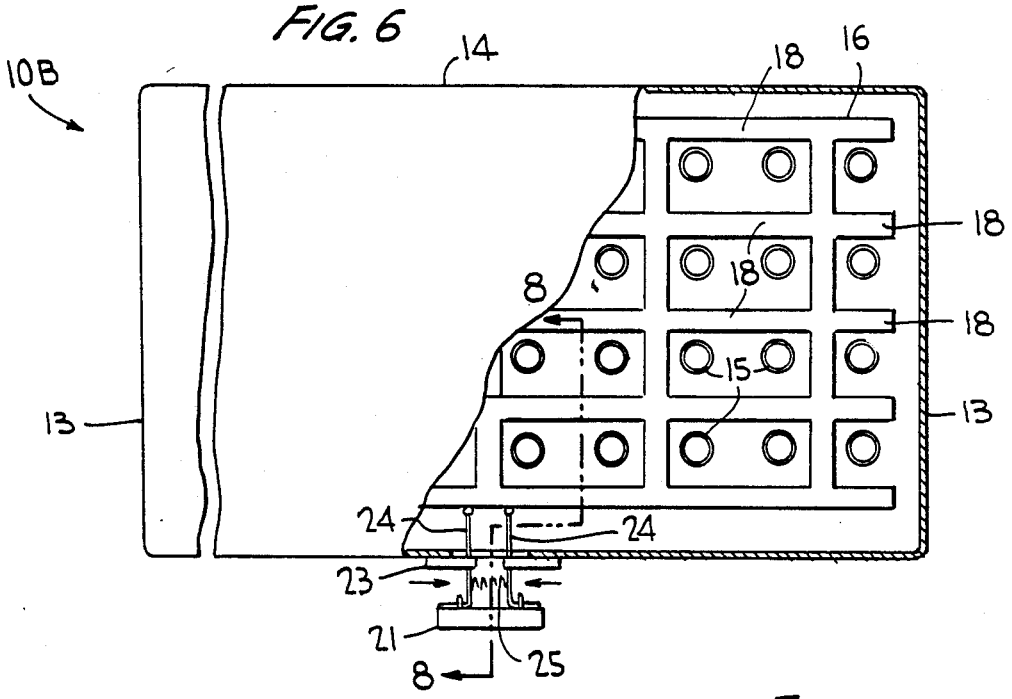
FIG. 6 is a top plan view, partly broken away, of a sleep unit according to yet another embodiment of the invention.
Figure 7:
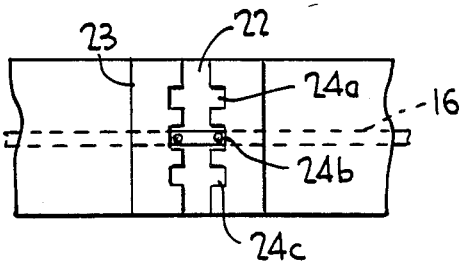
FIG. 7 is a partial side view of the FIG. 6 sleep unit.
Figure 8:
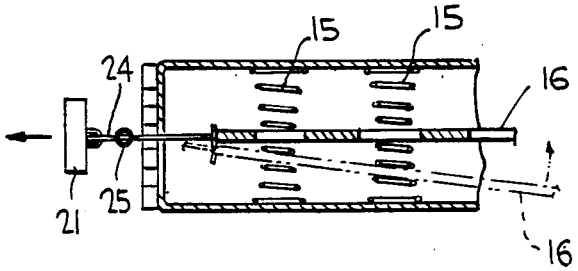
FIG. 8 is a sectional view taken substantially along the line 8—8 of the FIG. 6.

A further embodiment of the invention is generally designated 10B in FIG. 6 in which movable wall 16 likewise comprises a frame having slats defining portions 18. However, the frame is movable in a direction parallel to end walls 13 by the provision of a single handle 21. The opposing sides 24 of the handle shank may be spring biased apart by the provision of a coil spring 25 or the like. Thus, the operator simply presses sides 24 together for shifting the handle shank between the different guide slots. This movement of the handle in an up-and-down direction takes place while frame 16 is in its out-of-service position of FIG. 6, i.e. slots 18 are out of engagement with the inner coil springs. In such position, frame 16 is slanted downwardly in a position shown in the phantom outline in FIG. 8. The operator then simply pushes down on the handle so as to pivot frame 16 about the selected guide slots into a horizontal position shown in solid outline in FIG. 8, whereafter the handle is simply pulled toward the operator until slots 18 are shifted between the selected spaced turns of the inner springs. As in the other embodiments, movable wall 16 may be arranged for movement in a direction parallel to side walls 14, in keeping with the invention. Thus, slotted opening 22 may be located in one of end walls 13, the handle may extend from an adjacent end wall of the frame, and slats 18 may be associated with the cross rows of springs 15.

Obviously, many of the modifications and variations of the present invention are made possible in the light of the above teachings. For example, a single handle, of suitable length, which may be collapsible so as to lie against the sleep unit, may be provided for the FIGS. 1 and 5 movable internal walls. It is therefore to be understood that within the scope of the appended claims the invention may be practiced otherwise than specifically described.

What is claimed is:

1. A sleep unit, comprising interconnected top, bottom, side and end walls, a plurality of spaced inner coil springs arranged in rows parallel to said side and end walls and extending between said top and bottom walls, said springs having spring turns spaced apart a predetermined distance, a movable spring engagable, flat wall disposed within the unit between said walls thereof, said movable wall having a plurality of spaced portions extending parallel to said rows of springs, said portions each having a thickness less than said predetermined distance, and openings in said movable wall located between said spaced portions, said springs extending through said openings in an out-of-service position of said movable wall, one of said side and end walls having an opening defining guide slots for said movable wall, and said movable wall having a handle extending through said opening in said one wall, said guide slots extending in a direction parallel to said top and bottom walls, and a portion of said handle extending into a selected one of said guide slots upon manually shifting said movable wall from said out-of-service position to an in-service position in a direction perpendicular to said springs for inserting said portions of said movable frame into selected one of said turns of said coil springs for thereby adjusting the firmness of the sleep unit.

2. The sleep unit according to claim 1, wherein said movable wall comprises a flat plate containing rows of said openings corresponding to said rows of said springs.

3. The sleep unit according to claim 1, wherein said movable wall comprises a frame having interconnected slats defining said spaced portions.

4. The sleep unit according to claim 1, wherein said one wall comprises one of said side walls, said movable wall being shifted to said in-service position in a direction parallel to said side walls.

5. The sleep unit according to claim 4, wherein the other of said side walls has an opening defining guide slots extending in a direction parallel to said top and bottom walls, and said movable wall having a handle extending through said opening in said other side wall, and having a portion extending into a selected one of said guide slots of said other side wall opening upon manually shifting said movable wall to said in-service position.

6. The sleep unit according to claim 1, wherein said one wall comprises one of said side walls, said movable wall being shifted to said in-service position in a direction parallel to said end walls.

7. The sleep unit according to claim 1, wherein said handle portion is spring biased into said selected one of said guide slots.

* * * * *